US007291964B2

(12) United States Patent
Kim

(10) Patent No.: US 7,291,964 B2
(45) Date of Patent: Nov. 6, 2007

(54) COLOR CATHODE RAY TUBE

(75) Inventor: Sung Hun Kim, Busankwangyuk-si (KR)

(73) Assignee: LG. Philips Displays Korea Co., Ltd., Gumi si (KR)

( * ) Notice: Subject to any disclaimer, the term of this patent is extended or adjusted under 35 U.S.C. 154(b) by 0 days.

(21) Appl. No.: 10/855,413

(22) Filed: May 28, 2004

(65) Prior Publication Data

US 2005/0052114 A1 Mar. 10, 2005

(30) Foreign Application Priority Data

Sep. 5, 2003 (KR) ..... 10-2003-0062155
Nov. 11, 2003 (KR) ..... 10-2003-0079504

(51) Int. Cl.
*H01J 29/86* (2006.01)
*H01J 29/10* (2006.01)

(52) U.S. Cl. ..... 313/477 R; 313/461; 220/2.1 A

(58) Field of Classification Search ..... 313/440, 313/421, 422, 461, 477 R, 478, 479, 480, 313/481, 482, 495; 220/2.1 A, 2.1 R, 2.3 A, 220/2.3 R See application file for complete search history.

(56) References Cited

U.S. PATENT DOCUMENTS 4,593,225 A * 6/1986 Dietch et al. ..... 313/407
5,449,969 A * 9/1995 Washburn ..... 313/440
6,534,908 B1 * 3/2003 Nose et al. ..... 313/477 R
6,677,702 B2 * 1/2004 Kim et al. ..... 313/477 R
2004/0027046 A1 * 2/2004 Choo ..... 313/477 R
2005/0052112 A1 * 3/2005 Kim ..... 313/477 R

FOREIGN PATENT DOCUMENTS

JP 62160641 A * 7/1987

* cited by examiner

*Primary Examiner*—Mariceli Santiago
*Assistant Examiner*—Anne M Hines
(74) *Attorney, Agent, or Firm*—Birch, Stewart, Kolasch & Birch, LLP

(57) ABSTRACT

The present invention relates to a color cathode ray tube and more specifically to a color cathode ray tube in which mechanical stress due to internal pressure made by evacuation is decreased. According to an aspect of the present invention, a cathode ray tube includes a panel on inner surface of which a phosphor screen is formed, a funnel joined to the panel, and an electron gun generating electron beams wherein the panel satisfies a condition: CFT/SET≦0.92 wherein CFT is thickness of central portion of the panel and SET is thickness of skirt portion of the panel.

5 Claims, 4 Drawing Sheets

ANSYS 5.6
APR 4 2003
13:53:25
ELEMENTS
PowerGraphics
EFACET=1

XV =1
YV =1
ZV =1
DIST=189.492
XF =149.11
YF =116.69
ZF =39.475
CENTROID HIDDEN

COLOR CATHODE RAY TUBE

This Non-provisional application claims priority under 35 U.S.C. § 119(a) on Patent Application No(s). 10-2003-0062155 and 10-2003-0079504 filed in Korea on Sep. 5, 2003 and Nov. 11, 2003, the entire contents of which are hereby incorporated by reference.

TECHNICAL FIELD

The present invention relates to a color cathode ray tube and more specifically to a color cathode ray tube in which mechanical stress due to internal pressure made by evacuation is decreased.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 1, a tubular neck 13, and a funnel 2 connecting the panel 1 and the neck 13.

The panel 1 comprises faceplate portion and peripheral sidewall portion sealed to the funnel 2. A phosphor screen 4 is formed on the inner surface of the faceplate portion. The phosphor screen 4 is coated by phosphor materials of R, G, and B. A multi-apertured color selection electrode, i.e., shadow mask 3 is mounted to the screen with a predetermined space. The shadow mask 3 is hold by main and sub frames 7 and 8. An electron gun is mounted within the neck 13 to generate and direct electron beams 6 along paths through the mask to the screen.

The shadow mask 3 and the frame 7 constitute a mask-frame assembly. The mask-frame assembly is joined to the panel 1 by means of springs 9.

The cathode ray tube further comprises an inner shield 10 for shielding the tube from external geomagnetism and a reinforcing band 12 attached to the sidewall portion of the panel 10 to prevent the cathode ray tube from being exploded by external shock. The cathode ray tube further comprises external deflection yokes 5 located in the vicinity of the funnel-to-neck junction and a magnet 11 attached to the rear side of the deflection yokes 5 for amending electron bean trajectory.

Process for making the color cathode ray tube comprises generally pre-process and post-process.

During the pre-process, phosphor materials are deposited on the inner surface of the panel.

The post-process comprises further sub processes as follows. Firstly, after the phosphor materials are deposited, sealing process is performed. In the sealing process, a panel to which mask-frame assembly is mounted and a funnel on the inner surface of which frit is deposited is sealed together in a high temperature furnace. Then, evacuating process is performed where electron gun is inserted in the neck. Thereafter, an evacuating and sealing process is performed, in which the cathode ray tube is evacuated and sealed.

Since the cathode ray tube is evacuated, it suffers from high tensile and compressive stress. Therefore, a reinforcing process is conducted where reinforcing band 12 is attached to the panel to distribute the stress over the panel.

FIG. 2 shows a schematic view of distributions of stresses generated in the panel and funnel glasses after the evacuation process. In FIG. 2, dotted and solid lines represent compressive and tensile stresses, respectively.

In general, when a glass gets a shock from outside, cracks appear in the glass. Tensile stress may hasten increase of the cracks such that the glass may even be broken by the cracks. On the contrary, compressive stress disturbs increase of the cracks. As shown in FIG. 2, central portion of the panel gets compressive stress while corner portion and seal line portion get tensile stress. Therefore, the central portion is relatively strong against shock. However, the corner portion and the seal line portion are easily broken by outside shock.

Moreover, the cathode ray tube becomes slim recently. As the cathode ray tube becomes slimmer, stress problem becomes more severe. This is because volume of the panel decreases while the degree of vacuum is not changed as the cathode ray tube becomes slimmer.

Further, the cathode ray tube where the funnel portion where yokes are attached are made to have rectangular shape to reduce power consumption suffers larger tensile stress. Those cathode ray tubes are easily broken during heat treatment processes.

In order to reduce the effect of the tensile stress on the funnel glass, heat treatment is conducted for the cathode ray tube to generate compressive stress for increasing shock tolerance. However, those treatments increase manufacturing costs.

SUMMARY OF THE INVENTION

An object of the present invention is to provide a cathode ray tube where stress is effectively reduced and shock tolerance is achieved.

According to an aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein said panel satisfies a condition: $CFT/SET \leqq 1.04$ wherein CFT is thickness of central portion of said panel and SET is thickness of skirt portion of said panel.

DETAILED DESCRIPTION

Preferred embodiments of the present invention will be described in a more detailed manner with reference to the drawings.

According to an aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein said panel satisfies a condition: CFT/SET≦1.04 wherein CFT is thickness of central portion of said panel and SET is thickness of skirt portion of said panel.

Figure 1:
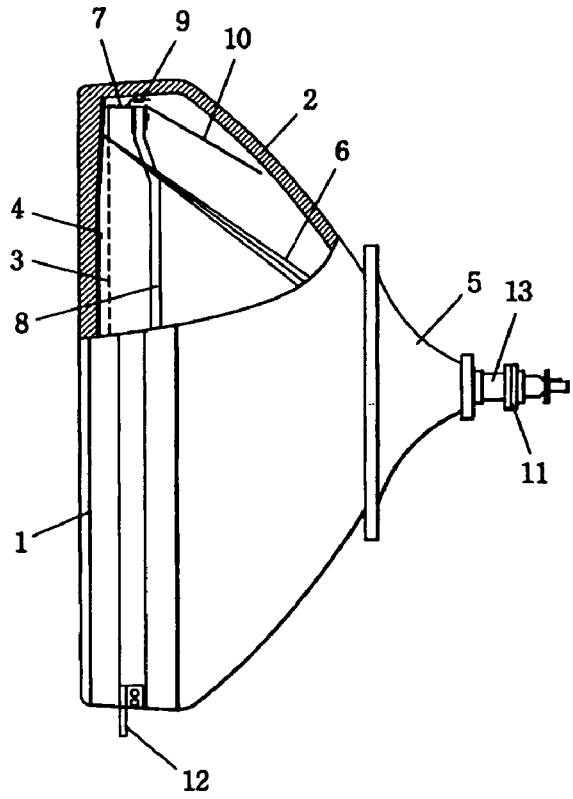
FIG. 1 shows a schematic diagram illustrating the structure of a general color cathode ray tube.
Figure 2:
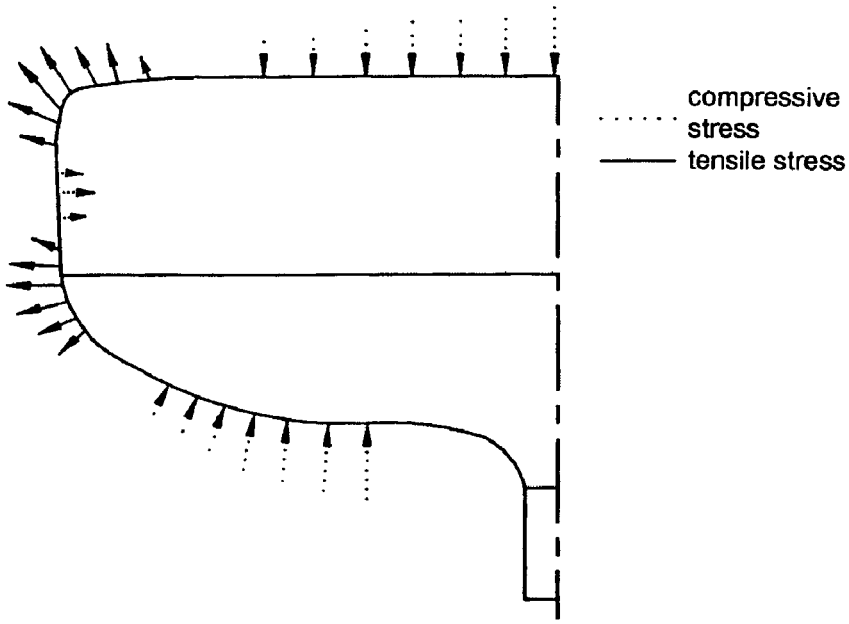
FIG. 2 shows a schematic view of distributions of stresses generated in the panel and funnel glasses after the evacuation process.
Figure 3:
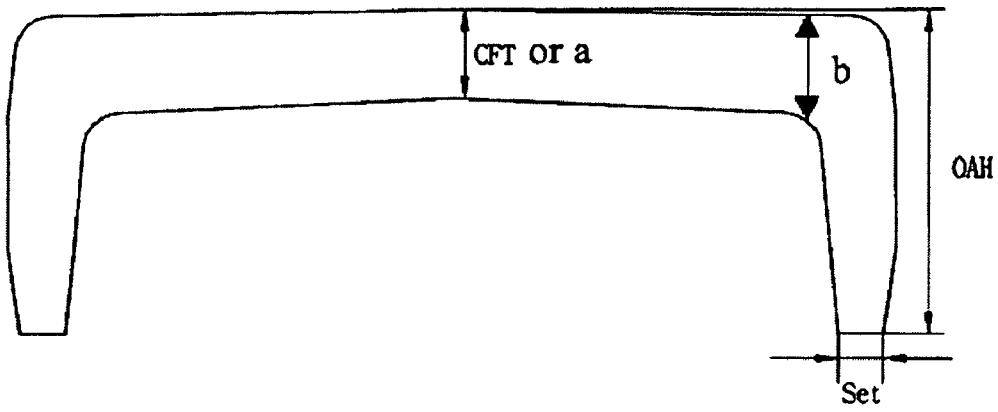
FIG. 3 shows a cross sectional view of the panel according to the present invention.

FIG. 3 shows a cross sectional view of the panel according to the present invention.

Hereinafter, thickness of central panel portion which is intersected by the deflection axis X is defined as a. Thickness of panel at the corner portion is defined as b. Then, b/a is called wedge ratio. According to the present invention, if wedge ratio is no smaller than 1.5, stress is reduced and, additionally, tolerance against shock is increased.

In FIG. 3, thickness of panel portion which is intersected by the deflection axis X is defined as CFT. Thickness of skirt portion of the panel is defined as SET. The overall width of panel structure measured along the deflection axis X is defined as OAH.

Table 1 is the result of an experiment where stress was measured across the funnel for various values of CFT, OAH, and SET according to the present invention and stress values of the prior art.

TABLE 1

| | conventional | present invention | | | | |
|---|---|---|---|---|---|---|
| position | 1 | 1 | 2 | 3 | 4 | 5 |
| CFT | 12.5 | 10.5 | 10.5 | 10.5 | 10.5 | 12.5 |
| OAH | 110 | 90 | 90 | 90 | 100 | 110 |
| SET | 11.4 | 13 | 14 | 16 | 11.4 | 12 |
| CFT/SET | 1.10 | 0.81 | 0.75 | 0.66 | 0.92 | 1.04 |
| OAH/SET | 9.65 | 6.92 | 6.43 | 5.63 | 8.77 | 9.17 |
| stress (panel) | 30.5 Mpa | 16.8 Mpa | 14.0 Mpa | 13.6 Mpa | 14.6 Mpa | 15.7 Mpa |

As shown in Table 1, when CFT/SET satisfies CFT/SET≦1.04, stress is remarkably reduced in comparison with the prior art. Thus, if CFT/SET is 1.04 or below, a cathode ray tube may be provided where stress is remarkably reduced.

Preferably, if OAH/SET is 1.04 or below, a cathode ray tube may be provided where stress is remarkably reduced.

Figure 4A:
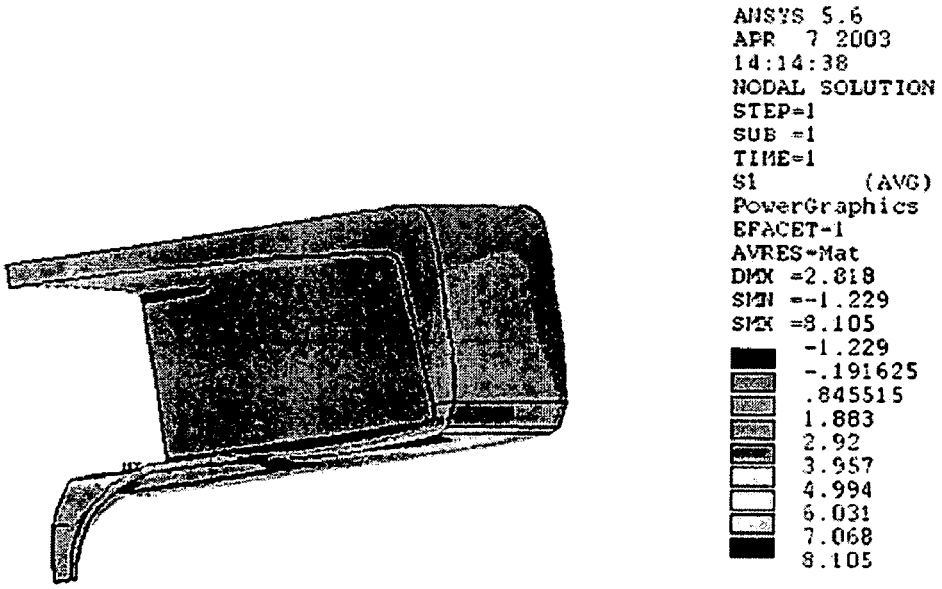
FIGS. 4*a* and 4*b* show a diagram for showing stress and deflection angle distribution analysis.
Figure 4B:
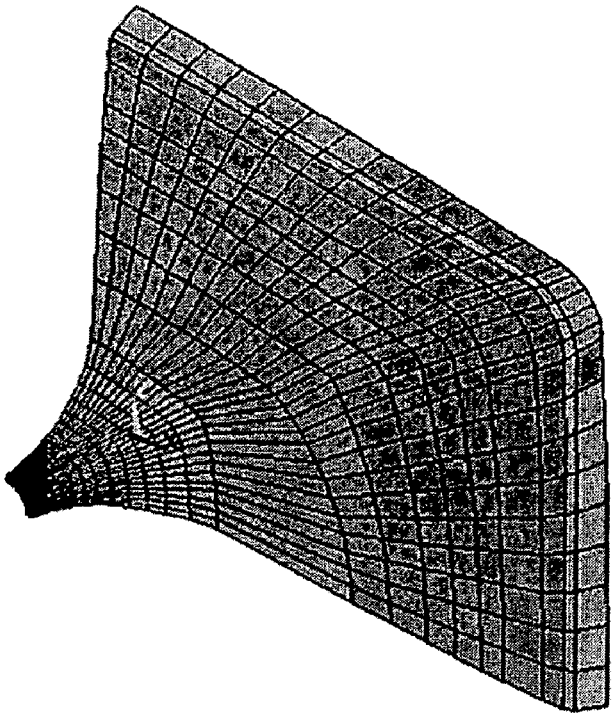

FIG. 4*a* shows a diagram for showing stress and FIG. 4*b* shows a diagram for showing deflection angle distribution analysis. As shown in FIG. 4*a* and FIG. 4*b*, when CFT/SET and OAH/SET are optimized, stress is also reduced accordingly.

Figure 5:
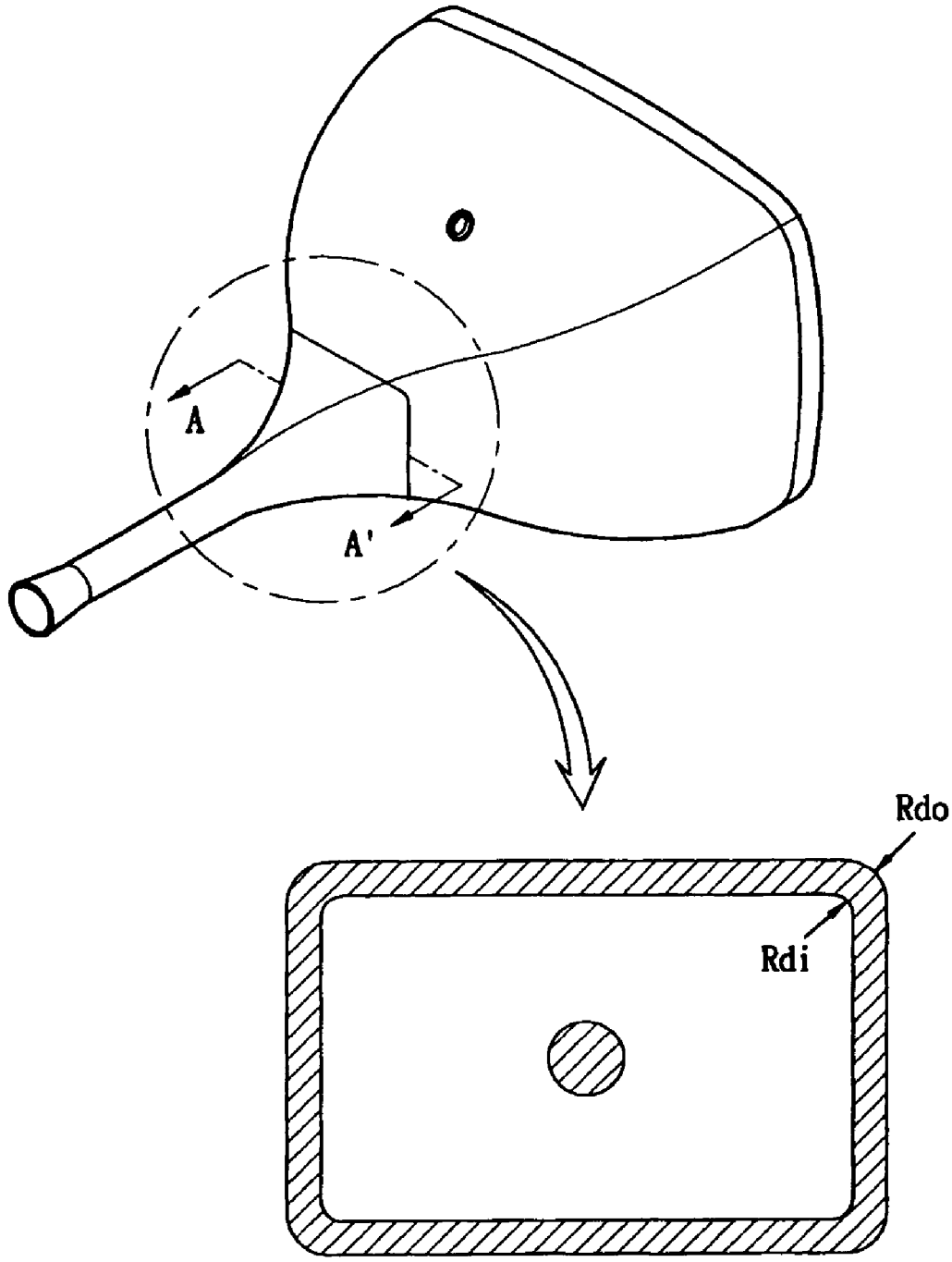
FIG. 5 shows a schematic diagram of a cathode ray tube in accordance with another embodiment of the present invention.

FIG. 5 shows a schematic diagram of a cathode ray tube in accordance with another embodiment of the present invention.

As shown in FIG. 5, cross section of the yoke portion of the funnel has rectangular shape. In comparison with the conventional funnel which has round neck portion, the cathode ray tube of rectangular shape neck portion may consume less power than the conventional one does.

Further, the every embodiments described hereinabove may be applied to a flat type color cathode ray tube where outer surface of panel is substantially flat. Therefore, the effect of the present invention is still effective for the flat type color cathode ray tube.

INDUSTRIAL APPLICABILITY

According to the present invention, a panel and funnel structure is provided which have wide deflection angle and slimmer shape while stress over the funnel is reduced remarkably. Further, the cathode ray tube in accordance with the present invention has larger tolerance against shock in comparison with the prior art.

The invention claimed is:

1. A cathode ray tube, comprising:

a panel on an inner surface of which a phosphor screen is formed;

a funnel joined to the panel; and an electron gun generating electron beams, wherein said panel satisfies a condition:

$$0.78 \leqq CFT/SET \leqq 0.92, \text{ and}$$

wherein the CFT is a thickness of a central portion of said panel and the SET is a thickness of a skirt portion of said panel.

2. The cathode ray tube of claim 1, wherein a wedge ratio of said panel is no smaller than 1.5, and wherein the wedge ratio is defined as b/a, b is a thickness of the panel at a corner portion and a is the thickness of the panel at the central portion.

3. The color cathode ray tube of claim 1, wherein said panel satisfies a condition:

$$OAH/SET \leqq 9.2, \text{ and}$$

wherein the OAH is overall height of said panel and the SET is the thickness of the skirt portion of said panel.

4. The cathode ray tube of claim 1, wherein a cross section of a yoke portion of said funnel has a substantially rectangular shape.

5. The cathode ray tube according to claim 1, wherein an outer surface of said panel is substantially flat.

* * * * *